US010060211B2

(12) United States Patent
Sonar et al.

(10) Patent No.: US 10,060,211 B2
(45) Date of Patent: Aug. 28, 2018

(54) ROTATIONAL ANCHORING OF DRILL TOOL COMPONENTS

(71) Applicant: Halliburton Energy Services, Inc., Houston, TX (US)

(72) Inventors: Sandip Satish Sonar, Leduc (CA); Mukesh Bhaskar Kshirsagar, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 205 days.

(21) Appl. No.: 14/898,541

(22) PCT Filed: Sep. 4, 2013

(86) PCT No.: PCT/US2013/058068
§ 371 (c)(1),
(2) Date: Dec. 15, 2015

(87) PCT Pub. No.: WO2015/034491
PCT Pub. Date: Mar. 12, 2015

(65) Prior Publication Data
US 2016/0130895 A1 May 12, 2016

(51) Int. Cl.
*E21B 23/01* (2006.01)
*E21B 7/06* (2006.01)

(52) U.S. Cl.
CPC ..... *E21B 23/01* (2013.01); *E21B 7/062* (2013.01); *E21B 7/067* (2013.01); *E21B 7/068* (2013.01)

(58) Field of Classification Search
CPC ..... E21B 23/01; E21B 7/062; E21B 7/067; E21B 7/068
See application file for complete search history.

(56) References Cited

U.S. PATENT DOCUMENTS 2,812,821 A * 11/1957 Nelson ..... E21B 21/10 137/508
5,358,040 A * 10/1994 Kinley ..... E21B 17/1021 166/241.3

(Continued)

FOREIGN PATENT DOCUMENTS

CN 105408577 A 3/2016
EP 1344893 A2 9/2003

(Continued)

OTHER PUBLICATIONS

"Australian Application Serial No. 2013399678, First Examiner Report dated Apr. 12, 2016", 3 pgs.

(Continued)

*Primary Examiner* — Nicole Coy
*Assistant Examiner* — Yanick A Akaragwe
(74) *Attorney, Agent, or Firm* — Gilliam IP PLLC

(57) ABSTRACT

A rotational anchor mechanism is mounted on an operatively nonrotating housing that forms part of a drill string. An anchor linkage forming part of the anchor mechanism is radially extendable and contractible to move an anchor member, such as a roller, mounted on the anchor linkage radially towards and away from the housing, to engage a borehole wall for resisting rotation of the housing relative to drill pipe that is drivingly rotated within the housing. The anchor linkage includes operatively coupled mounting links mounted on the housing to pivot about respective mounting axes which are parallel to one another in a fixed spatial relationship. An actuating mechanism is coupled to the anchor linkage to exert an actuating force on the anchor linkage. An angular orientation of the actuating force relative to the housing varies in response to variation in radial expansion of the anchor linkage.

31 Claims, 7 Drawing Sheets

(56) References Cited

U.S. PATENT DOCUMENTS

| | | | | |
|---|---|---|---|---|
| 6,516,898 | B1 | 2/2003 | Krueger | |
| 7,188,689 | B2 * | 3/2007 | Maxwell | E21B 17/1014 166/241.6 |
| 2012/0018163 | A1 | 1/2012 | Nelson et al. | |
| 2013/0068479 | A1 * | 3/2013 | AlDossary | E21B 23/14 166/381 |

FOREIGN PATENT DOCUMENTS

| | | | |
|---|---|---|---|
| SU | 682642 | A1 | 8/1979 |
| SU | 964134 | A1 | 10/1982 |
| WO | WO-2015034491 | A1 | 3/2015 |

OTHER PUBLICATIONS

"International Application Serial No. PCT/US2013/058068, International Preliminary Report on Patentability dated Mar. 17, 2016", 11 pgs.
"Australian Application Serial No. 2013399678, Response filed Sep. 23, 2016 to First Examiner Report dated Apr. 12, 2016", 21 pgs.
"Russian Application Serial No. 2016101155, Office Action dated Aug. 30, 2016", (w/ English Translation), 16 pgs.
"Chinese Application Serial No. 2013800782093, First Office Action dated Oct. 10, 2016.", 9 pages.
"International Application Serial No. PCT/US2013/058068, International Search Report dated Jun. 8, 2014", 3 pgs.
"International Application Serial No. PCT/US2013/058068, Written Opinion dated Jun. 8, 2014", 9 pgs.
"Venezuela Application Serial No. 2014-001040, Office Action dated Nov. 7, 2014", 1 pg.

* cited by examiner

ROTATIONAL ANCHORING OF DRILL TOOL COMPONENTS

PRIORITY APPLICATION

This application is a U.S. National Stage Filing under 35 U.S.C. 371 from International Application No. PCT/US2013/058068, filed Sep. 4, 2013; and published as WO 2015/034491 on Mar. 12, 2015; which application and publication are incorporated herein by reference in their entirety.

TECHNICAL FIELD

This disclosure relates generally to components of drill strings in drilling operations, and to methods of operating downhole drill tools. Some embodiments relate more particularly to rotational anchor systems, apparatuses, mechanisms, devices and methods for resisting rotation of particular downhole tool components during driven rotation of a drill string. The disclosure also relates to steering of a drill string, and to rotary steerable systems, apparatuses, mechanisms, and methods for steering a drill string.

BACKGROUND

Boreholes for hydrocarbon (oil and gas) production, as well as for other purposes, are usually drilled with a drill string that includes a tubular drill pipe having a drilling assembly which includes a drill bit attached to the bottom end thereof. The drill bit is rotated to shear or disintegrate material of the rock formation to drill the wellbore. Rotation of the drill bit is often achieved by rotation of the drill pipe, e.g., from a drilling platform at a wellhead. Instead, or in addition, at least part of the drill pipe is in some applications driven by a mud motor forming part of the drill string adjacent the drill bit.

Some elements of the drill string, however, may include non-rotating or rotationally static components that are not to rotate during operation with the driven, rotating drill pipe. Instead, such non-rotating components are to maintain a substantially constant rotational orientation relative to a formation through which the borehole extends. Rotary Steerable Systems (RSS), for example, often comprise a non-rotating housing or sleeve that may slide longitudinally along the borehole with the drill string, but is not to rotate with the drill string during directional drilling operations.

When drilling oil and gas wells for the exploration and production of hydrocarbons, it is often necessary to deviate the well from the vertical along a particular direction. This is called directional drilling. Directional drilling is used, among other purposes, for increasing the drainage of a particular well by, for example, forming deviated branch bores from a primary borehole. It is also useful in the marine environment, where a single offshore production platform can reach several hydrocarbon reservoirs using a number of deviated wells that spread out in any direction from the production platform.

In directional drilling operations that employ rotary steerable systems having a non-rotating housing, housing roll is undesired. The stationary housing or sleeve, within which the drill pipe or tubular of the drill string typically rotates, provides a reference for steering of the drill bit during directional drilling. Any deviation from the reference tends to deviate the drilling operation from a desired well path.

Rotational stasis of the non-rotating housing is often achieved by a rotational anchor mechanism that is mounted on the housing and is radially expandable to press against the borehole wall, transferring rotation-resistive torque from the formation to the housing.

BRIEF DESCRIPTION OF THE DRAWINGS

Some embodiments are illustrated by way of example and not limitation in the figures of the accompanying drawings, in which.

DETAILED DESCRIPTION

Figure 1:
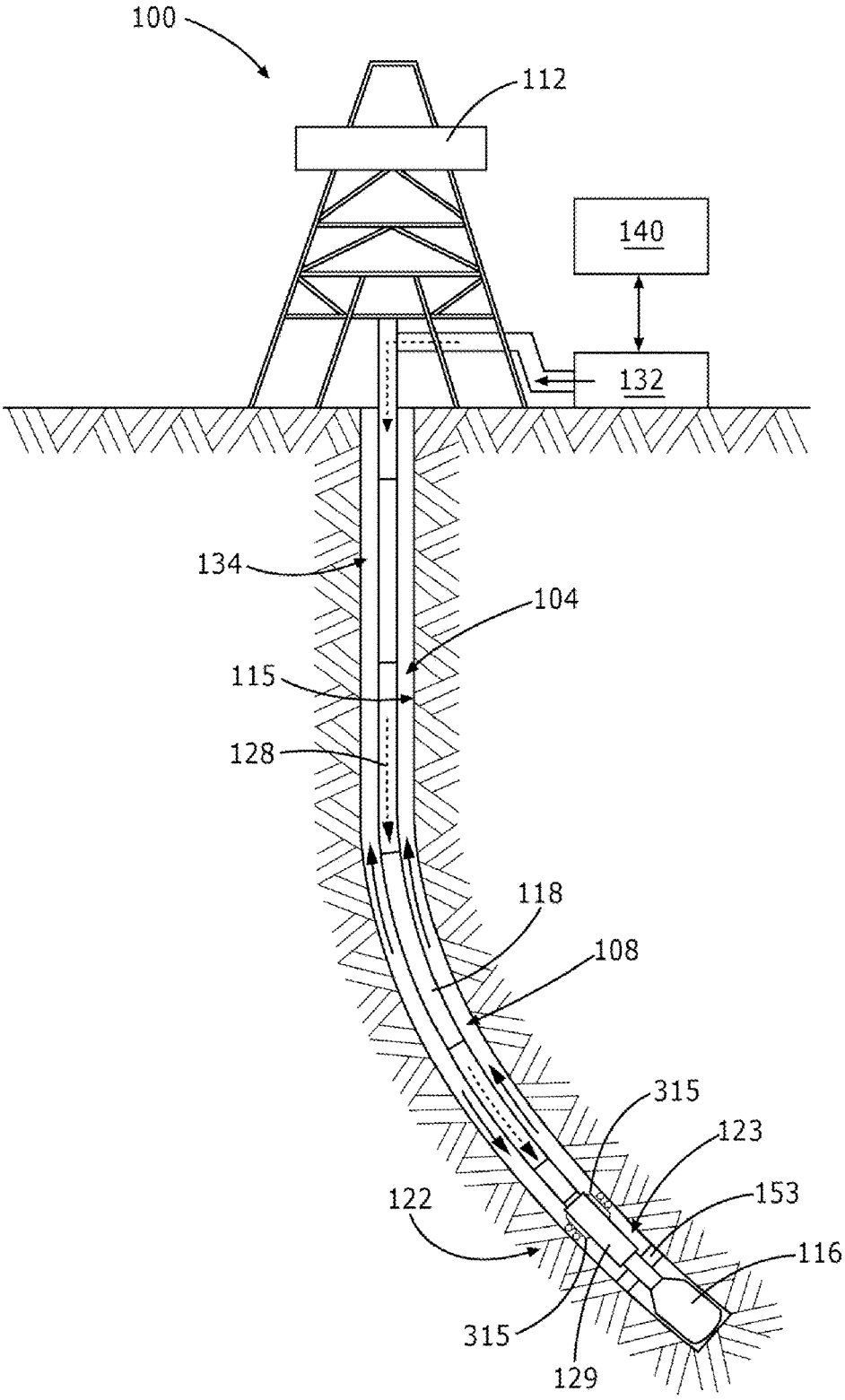
FIG. 1 depicts a schematic diagram of a drilling installation including a drill string that has a steering apparatus including a rotational anchor mechanism, in accordance with an example embodiment.

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

According to one aspect of the disclosure, a drill string and a drilling installation is provided with a rotational anchor mechanism mounted on an operatively non-rotating housing that forms part of the drill string, the rotational anchor mechanism comprising an anchor linkage that is radially extendable and contractible to move an anchor member, such as a roller, radially towards and away from the housing, to selectively engage a borehole wall for resisting rotation of the housing relative to drill pipe that is drivingly rotated within the housing. The anchor linkage may comprise a plurality of revolute link pairs (each of which comprises two rigid link members which are pivotally connected together), the plurality of revolute pairs having substantially parallel respective pivot axes, and a prismatic link pair pivotally connected to at least one of the revolute pairs, the prismatic pair comprising a pair of rigid members that are longitudinally aligned and longitudinally slidable relative to each other responsive to changes in the degree of radial expansion of the linkage mechanism.

The prismatic pair may thus provide a variable length link for the anchor linkage, being dynamically extendable and retractable responsive to changes in the degree of radial expansion of the linkage mechanism.

The anchor linkage may further comprise an actuating mechanism, such as a resiliently compressible spring, to urge the anchor member radially outwards into contact with the borehole wall. In some embodiments, a compression spring may act on the prismatic link pair, to urge extension of the composite variable link and to expand the anchor linkage.

FIG. 1 is a schematic view of an example embodiment of a drilling installation 100 that includes a drill string 108 having a rotary steerable system employing a rotational anchor mechanism 315 (see, e.g., FIG. 3) in accordance with an example embodiment.

The drilling installation 100 includes a subterranean borehole 104 in which the drill string 108 is located. The drill string 108 may comprise jointed sections of drill pipe suspended from a drilling platform 112 secured at a wellhead. A downhole assembly or bottom hole assembly (BHA) 122 at a bottom end of the drill string 108 may include a drill bit 116 to disintegrate earth formations at a leading end of the drill string 108, to pilot the borehole 104.

The borehole 104 is thus typically a substantially cylindrical elongated cavity, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein (unless the context clearly indicates otherwise), the "axis" of the borehole 104 (and therefore of the drill string 108 or part thereof) means a longitudinally extending centerline of the cylindrical borehole 104. "Axial" thus means a direction along a line substantially parallel with the lengthwise direction of the borehole 104 at the relevant point or portion of the borehole 104 under discussion; "radial" means a direction substantially along a line that at least approximately intersects the borehole axis and lies in a plane substantially perpendicular to the borehole axis; "tangential" means a direction substantially along a line that lies in a plane substantially perpendicular to the borehole axis, and that is radially spaced (at its point closest to the axis) from the borehole axis by a distance which is nontrivial in the context of the relevant discussion; and "circumferential" or "rotational" means a substantially arcuate or circular path described by rotation of a tangential vector about the borehole axis. Note that circumferential or rotational movement, at a given instant, comprises tangential movement.

As used herein, movement or location "forwards" or "downhole" (and derived or related terms) means axial movement or relative axial location along the borehole 104 towards the drill bit 116, further away from the surface. Conversely, "backwards," "rearwards," or "uphole" means movement or relative location axially along the borehole 104, away from the drill bit 116 and towards the earth's surface.

Drilling fluid (e.g. drilling "mud," or other fluids that may be in the well), is circulated from a drilling fluid reservoir, for example a storage pit, at the earth's surface, and coupled to the wellhead, indicated generally at 130, by a pump system 132 that forces the drilling fluid down a drilling bore 128 provided by a hollow interior of the drill string 108, so that the drilling fluid exits under relatively high pressure through the drill bit 116. After exiting from the drill string 108, the drilling fluid moves back upwards along the borehole 104, occupying a borehole annulus 134 defined between the drill string 108 and a wall 115 of the borehole 104. Although many other annular spaces may be associated with the installation 100, references to annular pressure, annular clearance, and the like, refer to features of the borehole annulus 134, unless otherwise specified or unless the context clearly indicates otherwise. Note that the drilling fluid is pumped along the inner diameter (i.e., the bore 128) of the drill string 108, typically provided by the drill pipe 118, with fluid flow out of the bore 128 being restricted at the drill bit 116. The drill pipe 118 of the drill string 108 therefore performs the dual functions of (a) transmitting torque and rotation from the wellhead to the drill bit 116, and (b) conveying drilling fluid downhole.

The drilling fluid then flows upwards along the annulus 134, carrying cuttings from the bottom of the borehole 104 to the wellhead, where the cuttings are removed and the drilling the drilling fluid reservoir 132.

The drilling installation 100 can include a rotary steerable system (RSS) that comprises a rotary steering tool 123 incorporated in the drill string 108 and forming an in-line part thereof. The steering tool 123 permits directional control over the drill bit 116 during rotary drilling operations, by controlling the orientation of the drill bit 116. In this manner, the direction of the resulting wellbore or borehole 104 can be controlled.

Figure 2:
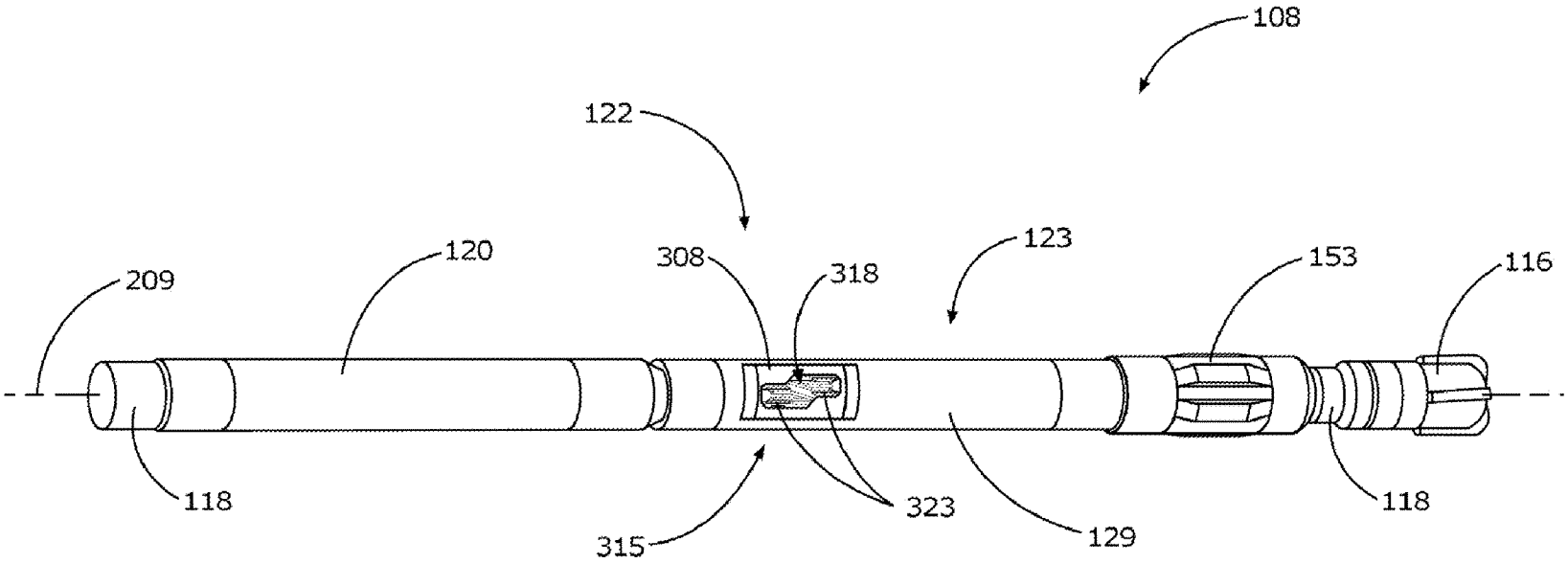
FIG. 2 depicts a pictorial side view of a bottom hole assembly of a drill string having a steering apparatus that comprises a rotational anchor mechanism, in accordance with an example embodiment.

The steering tool 123 in this example embodiment comprises a tubular sleeve or housing 129 that extends lengthwise along a part of the drill string 108, co-axially receiving part of the drill pipe 118 (see, e.g., FIG. 2). That portion of the drill pipe 118 which passes through the housing 129 is further referred to as a driveshaft, but note that the entire length of the drill pipe 118 effectively functions as a driveshaft, transferring torque and rotation from a drive system at the drilling platform 112 to the drill bit 116. The steering tool 123 can thus comprise a section of drill pipe 118, providing the driveshaft, with the housing 129 mounted on it. The housing 129 is substantially co-axially mounted on the driveshaft, the driveshaft being rotatable relative to the housing 129 to allow driven rotation of the driveshaft within the housing 129 while the housing 129 maintains a constant rotational orientation. Note that the housing 129 may serve to bend or deviate the direction of the drill pipe 118, and may therefore not at all times be perfectly co-axial with the drill pipe 118. Terminology referring to a co-axial arrangement of these components is to be understood as including such slight misalignment. Similarly, description of rotatable mounting of the housing 129 on the drill pipe 118 means not that the housing 129 is rotated during the drilling operation, but instead indicates that the housing 129 and the drill pipe 118 are not rotationally keyed together, and are thus rotatable relative to each other, in use allowing nonrotation of the housing 129.

The rotational anchor device 315 is mounted on the housing 129 to resist rotation of the housing 129 with the drill pipe 118 around a longitudinal axis 209 (FIG. 2) of the drill string 108, so that the housing 129 is substantially stationary with respect to rotation. The rotational anchor device 315 is configured to achieve such rotational anchoring by engagement with a wall 115 of the borehole 104, so that resistive torque is transferred from the borehole wall 115 to the housing 129, via the rotational anchor device 315. Operation of an example rotational anchor device 315 will be described in greater depth with reference to FIGS. 3-9.

Directional drilling control by use of an apparatus that comprises a stationary component, such as the housing 129, is known in the art, in this example embodiment comprising deflection of the driveshaft's axis along the length of the housing 129, e.g., by shaft bending mechanisms carried by the housing 129. As mentioned, non-rotation of the housing 129 during such steering operations is of critical importance to accurate steering, as the stationary housing 129 serves to reference the steering direction.

The BHA 122 can further comprise a near bit stabilizer 153 (see also FIG. 2) that is located closely behind the drill bit 116, adjacent a downhole end of the housing 129.

The installation 100 may include a surface control system 140 to receive signals from downhole sensors and devices telemetry equipment, the sensors and telemetry equipment being incorporated in the drill string 108. In this example embodiment, the BHA 122 comprises a measurement and control assembly 120 connected in-line in the drill string 108 and being located immediately uphole of the steering tool 123. The measurement and control assembly 120 can include instrumentation equipment to measure borehole parameters, drill string performance, and the like. The assembly 120 can further include telemetry equipment to permit communication with the surface control system 140, e.g., to transmit measurement and instrumentation information, and to receive control signals from the surface control system 140. Such control signals may include operator-issued steering commands which are relayed to the steering tool 123.

The surface control system 140 may display drilling parameters and other information on a display or monitor that is used by an operator to control the drilling operations. Some drilling installations may be partly or fully automated, so that drilling control operations may be either manual, semi-automatic, or fully automated. The surface control system 140 may comprise a computer system having one or more data processors and data memories. The surface control system 140 may process data relating to the drilling operations, data from sensors and devices at the surface, data received from downhole, and may control one or more operations of downhole tools and devices that are downhole and/or surface devices.

Figure 3:
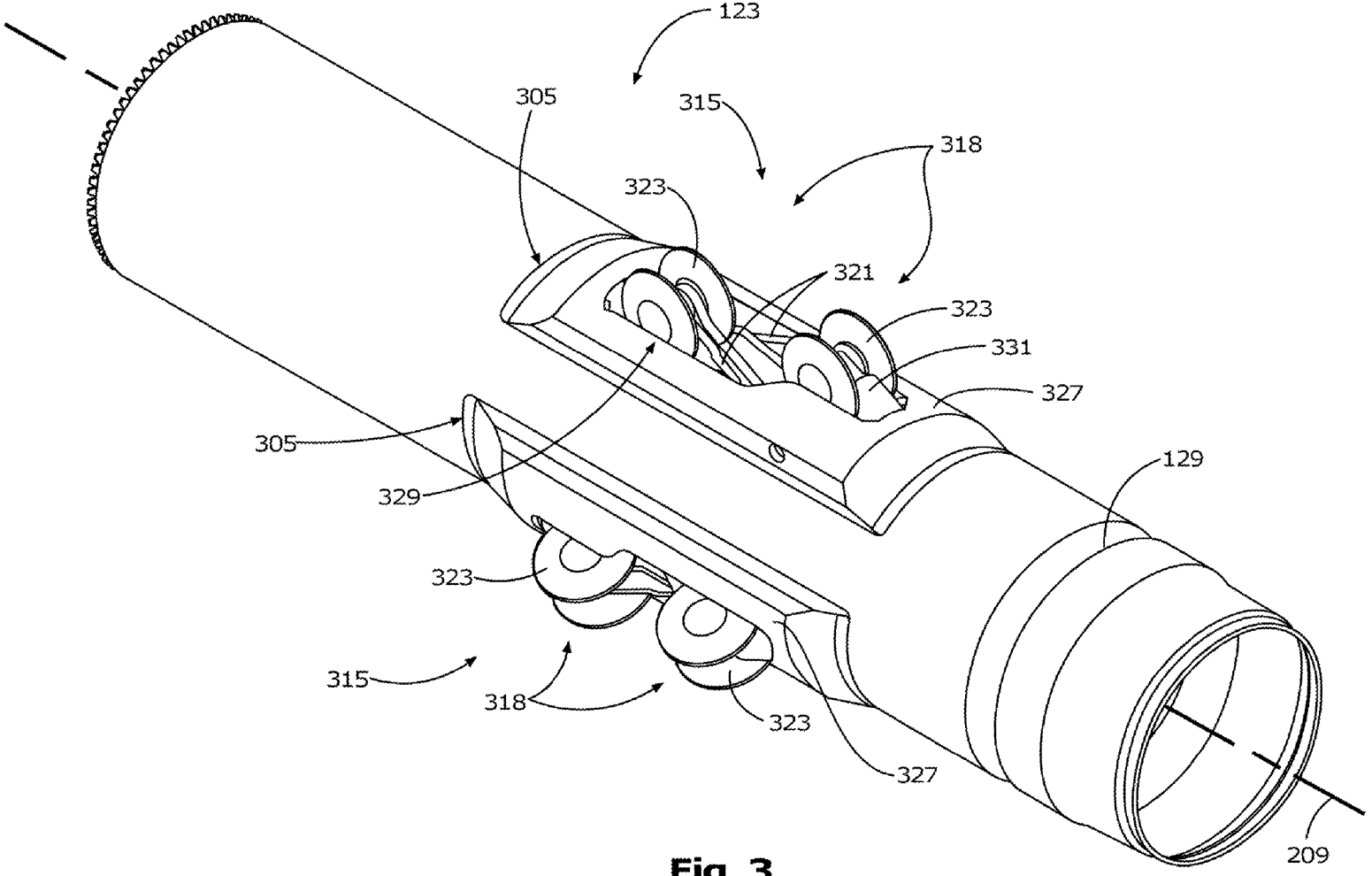
FIG. 3 depicts an isolated three-dimensional view of a non-rotating tool housing comprising a rotational anchor mechanism, in accordance with an example embodiment.

FIG. 3 shows a three-dimensional view of the steering tool 123 in accordance with one example embodiment. The housing 129 is, in this example embodiment, provided with three rotational anchor devices 315, which are spaced circumferentially about the housing 129 at regular intervals, so that neighboring rotational anchor devices 315 are spaced apart by 120°.

In this example, each rotational anchor device 315 is provided by an assembly that forms a modular removable and replaceable attachment or insert that is semi-permanently attached to a radially outer surface of the housing 129. The housing 129 is thus shaped so that it defines a complementary receiving cavity or socket 305 for each of devices 315.

Each rotational anchor device 15 comprises a body or frame 308 that is semi-permanently attached to the housing 129, with a pair of rotational anchor mechanisms 318 being housed in and connected to the frame 308. The rotational anchor mechanisms 318 each comprises an anchor linkage 321 that displaceably connects an anchor member in the example form of a roller 323 to the housing 129. Each anchor linkage 321 is independently extendable radially outwards from the housing 129, to move the roller 323 radially away from the housing 129 and towards the borehole wall 115. Conversely, the anchor linkage 321 is radially contractible from such an extended position, responsive to forced movement of the roller 323 radially closer to the housing 129.

The anchor linkages 321 of the pair of rotational anchor mechanisms 318 in a particular device 315 are identical, but have opposite longitudinal orientations, so that their rollers 323 are longitudinally staggered. In this example, each roller 323 comprises a pair of disc-shaped blades 325 (see, e.g., FIG. 6) that are co-axially mounted on a common spindle 537 (FIG. 5) which pivotally connects together component parts of the anchor linkage 321 (as will be described in greater specificity below).

A rotational axis 412 (see, e.g., FIG. 4) of each of the rollers 323 is oriented more or less tangentially relative to the longitudinal axis of the housing 129, to provide rolling contact with the formation, permitting rolling of the roller blades 325 longitudinally along the cylindrical borehole wall 115 responsive to longitudinal movement of the drill string 108 on which the housing 129 is mounted. The roller blades 325 may be configured to penetrate the borehole wall 115, in this example embodiment tapering towards its radially peripheral edge. In use, the blades 325 may thus cut into the borehole wall 115 to promote transfer of resistive torque to the blades 325 by the wall while allowing for longitudinal movement along it.

As can be seen in FIG. 3, a part-cylindrical plate of the frame 308 defines a cover 327 that extends partially over the articulated anchor linkages 321, effectively forming part of the radially outer surface of the housing 129. The cover 327 defines an opening or slot 329 that permits radial passage of the linkage components and the rollers 323 through the cover 327 (see also FIG. 7).

Figure 4A:
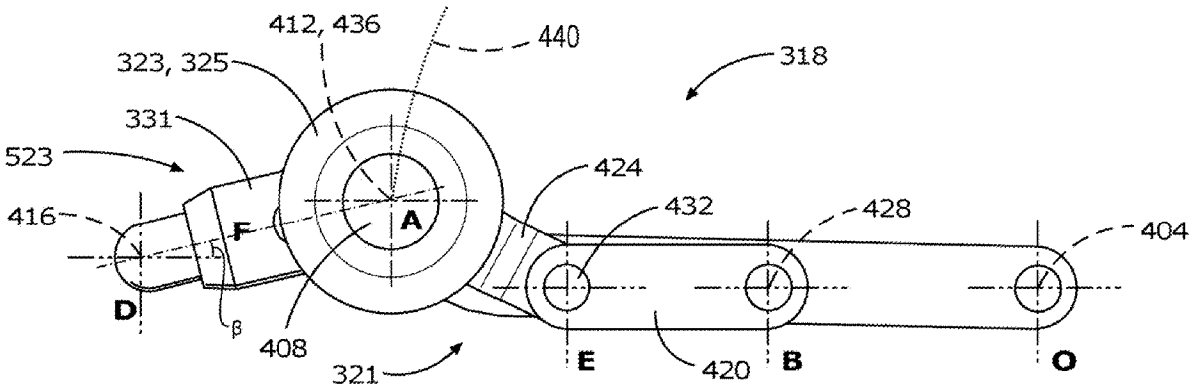
FIG. 4A-4B depict isolated side views of a rotational anchor mechanism in accordance with an example embodiment, illustrating an anchor linkage of the rotational anchor mechanism in a fully retracted condition (FIG. 4A) and in an expanded condition (FIG. 4B).
Figure 4B:
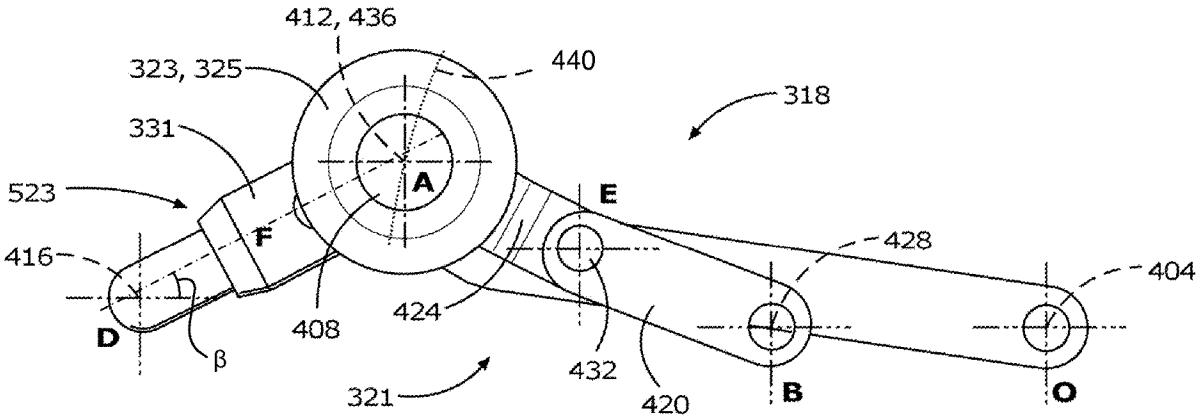

For clarity of illustration, FIGS. 4A and 4B show one of the rotational anchor mechanisms 318 in isolation, with the anchor linkage 321 being in a fully retracted condition in FIG. 4A and being in a fully extended condition in FIG. 4B. The example anchor linkage 321 comprises a plurality of links that are connected together and/or are mounted such that ends of the respective links pivot about a respective pivot axis. The pivot axes may be substantially parallel (being approximately tangential relative to the axis of the housing), so that the anchor linkage 321 provides a so-called planar linkage.

One of the links of the anchor linkage 321 may be variable in length, to dynamically change the distance between the axes about which it is pivotable. In this embodiment, such a variable link is provided by a telescopic bar 331 comprising relatively displaceable link components in the example form of a pair of rigid metal tubes 519 (see FIG. 5) that are co-axially aligned and are slidably connected together, one of the tubes 519 being received within the other, telescope fashion. Note that although the telescopic bar 331 is described herein as a link of variable length, the tubes 519 can also be described as a pair of rigid link members that are slidably connected together to form a prismatic link pair.

Figure 5:
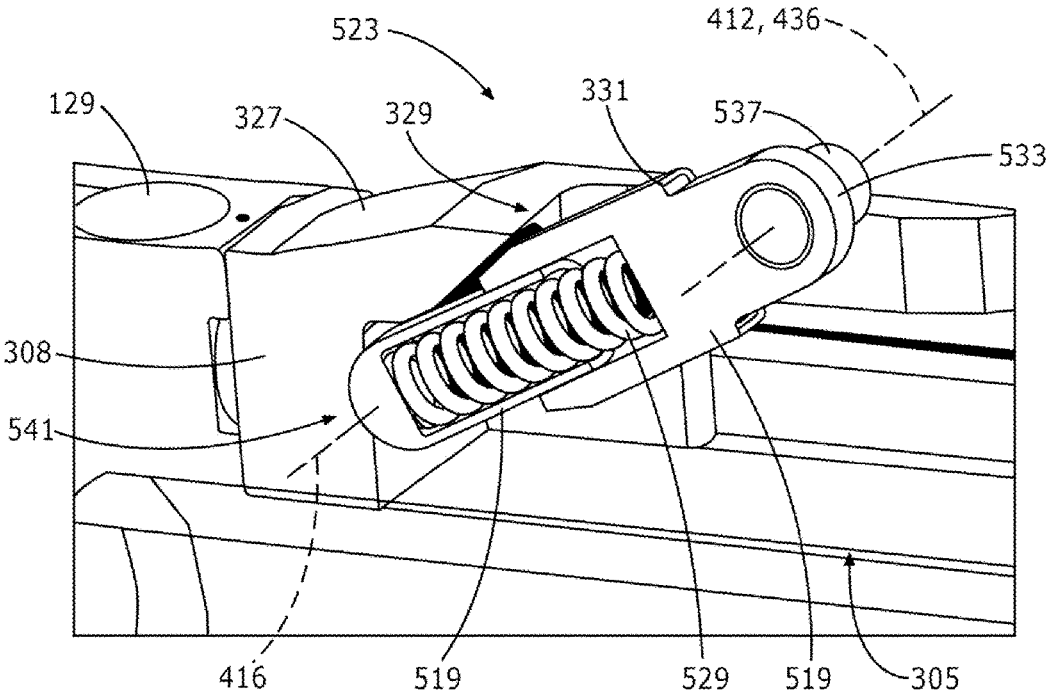
FIG. 5 depicts a sectioned three-dimensional view of a rotational anchor mechanism in accordance with an example embodiment, showing details of an example variable link that forms part of an anchor linkage, the variable link being dynamically variable in length responsive variation in a degree of radial expansion of the anchor linkage.

Turning briefly to FIG. 5, it will be seen that the telescopic bar 331 that provides the variable link forms part of an actuating mechanism 523 incorporated in the anchor linkage 321 to urge expansion of the anchor linkage 321. The actuating mechanism 523 may comprise a spring arrangement, in this example being a helical compression spring 529 that is co-axially located in an internal, longitudinally extending cavity defined together by the tubes 519 of the telescopic bar 331. Opposite ends of the spring 529 bear against the respective tubes 519, urging them apart.

A proximal one of the tubes 519 is mounted on the housing 129 (in this example via the frame 308) to be pivotable about a mounting axis 416 (labeled point D in FIG. 4) that is substantially tangential relative to the longitudinal axis 209, thus extending substantially perpendicular to the lengthwise direction of the borehole 104. A ball and socket joint 541 provides, in this example, the pivotable connection of the telescopic bar 331 to the housing 129, a proximal end of the proximal tube 519 having a part spherical convex exterior shape received in a complementary concave socket 305 provided by the frame 308 of the insert. Radial outward pivoting of the telescopic bar 331 is stopped at the extreme of its range of motion by obstruction on the cover 327, which position corresponds to a fully expanded condition of the anchor linkage. The anchor linkage is thus mounted to the housing 129 by the telescopic bar 331, which therefore provides a variable length mounting link pivotable about a fixed axis (416) relative to the housing 129. Note that the frame 308, when it is attached to the housing 129, is longitudinally, radially, and rotationally keyed to the housing 129, forming an integrated structural part of the housing 129, and description or references of connection or mounting of components to the housing 129 includes connection or mounting of such components to the frame 308, and vice versa.

Returning now to FIGS. 4A and 4B, it will be seen that the other links of the anchor linkage 321 are provided in this example embodiment by rigid link members of non-variable length, here being provided by rigid link bars. If the telescopic bar 331 is viewed as a single link of variable length, the anchor linkage 321 in this example comprises a four-link mechanism. The link bars comprise a rigid mounting link 400 (acting along line 0A), an indirect mounting link 420 (BE), and an intermediate link 424 (EA).

The rigid mounting link 400 is pivotally mounted at a proximal end thereof on the frame 308, to pivot about a mounting axis 404 (labeled point O) substantially parallel to the mounting axis 416 of the telescopic bar 331. The opposite, distal end of the rigid mounting link 400 is connected to the distal end of the telescopic bar 331 at an outer joint 408 (labeled point A), so that the telescopic bar 331 and the rigid mounting link 400 (0A) are relatively pivotable about a joint axis 436 that is substantially parallel to the mounting axes 416, 404. The rigid mounting link 400, in this example, is angled, forming a radially outward dogleg adjacent its distal end, to promote a low radial profile for the anchor linkage 321. The roller 323 is carried by the anchor linkage 321 at the outer joint 408, it is roller axis 412 being co-axial with the joint axis 436.

The indirect mounting link 420 (BE) is connected to the housing 129 in a manner similar to the rigid mounting link 400, being pivotable about a respective mounting axis 428 (labeled point B) that is parallel to the other mounting axes 416, 404. The indirect mounting link 420, is however, not directly pivotally connected to the outer joint 408, but is instead connected pivotally to the intermediate link 424 at a floating joint 432 having an associated pivot axis (labeled E) about which the indirect mounting link 420 and the intermediate link 424 are pivotable. The joint axis 436 is substantially parallel to the mounting axis 428. It will therefore be seen that each pair of pivotally interconnected rigid links form a revolute pair, with the variable link DA comprising a variable length component of revolute link pairs with links EA and OA.

The opposite, radially outer end of the intermediate link 424 is pivotally connected to both the rigid mounting link 400 and the telescopic bar 331 at the outer joint 408 (A), to pivot about the joint axis 436.

FIG. 4A shows the anchor linkage 321 in a fully retracted condition, in which the roller 323 is at an extreme radially inner position. FIG. 4B shows the anchor linkage 321 in a fully expanded condition, in which the roller 323 is at its furthest radial spacing from the housing 129. Note that expansion of the anchor linkage 321 comprises radially outward pivoting of all three the mounting links 331, 400, and 420, caused by urged extension of the telescopic bar 331. Movement of the outer joint axis 436 (and therefore of the roller 323) will describe an arc on a radius about the mounting axis 404, the rigid link bar that provides the rigid mounting link 400 (0A) extending directly between the mounting axis 404 and the outer joint axis 436. The mounting axes 404, 428, and 416 are fixed to the housing and are therefore in a fixed spatial relationship.

Note that, when in the fully retracted condition (FIG. 4A), the telescopic bar 331 extends at least partially radially outwards, so that a line between its mounting axis 416 and the outer joint axis 436 has a positive radial component. Such a radially outwardly disposed orientation in the retracted condition promotes ready expansion of the anchor linkage 321 by increasing a lever arm of a moment that is exerted on the rigid mounting link 400 (0A) by the telescopic bar 331. This lever arm can further be enhanced by selection of the radial positions of the mounting axis 416 and the mounting axis 404. As can be seen in FIG. 4A, for example, the mounting axis 416 of the telescopic bar 331 is positioned radially beyond the mounting axis 404 of the rigid mounting link 400 (0A), so that even if the telescopic bar 331 were to extend axially when it is fully retracted (which it does not do in this example), an actuating force acting along the length of the telescopic bar 331 would tend to pivot the rigid mounting link 400 (0A) radially outward.

Although the linkage mechanism of the anchor linkage 321 is described as being a planar linkage, this does not mean that the link bars and the telescopic bar 331 lie in a common plane, but instead conveys that the pivot axes of the linkage (e.g., of all of the pivot joints between links, and all of the pivotal mounting connections) are substantially parallel to one another.

Figure 6:
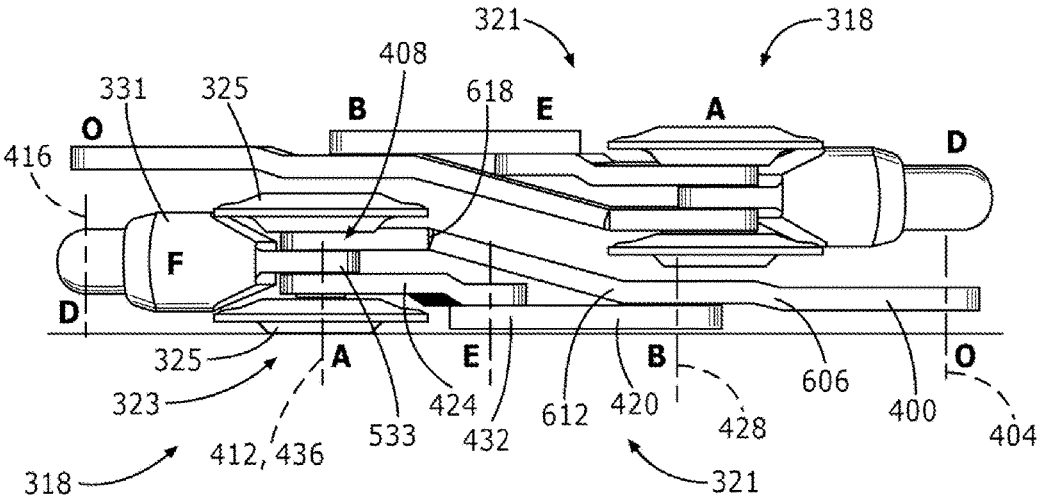
FIG. 6 depicts an isolated plan view of a pair of rotational anchor mechanisms forming part of a steering apparatus for drill string, in accordance with an example embodiment.
Figure 7:
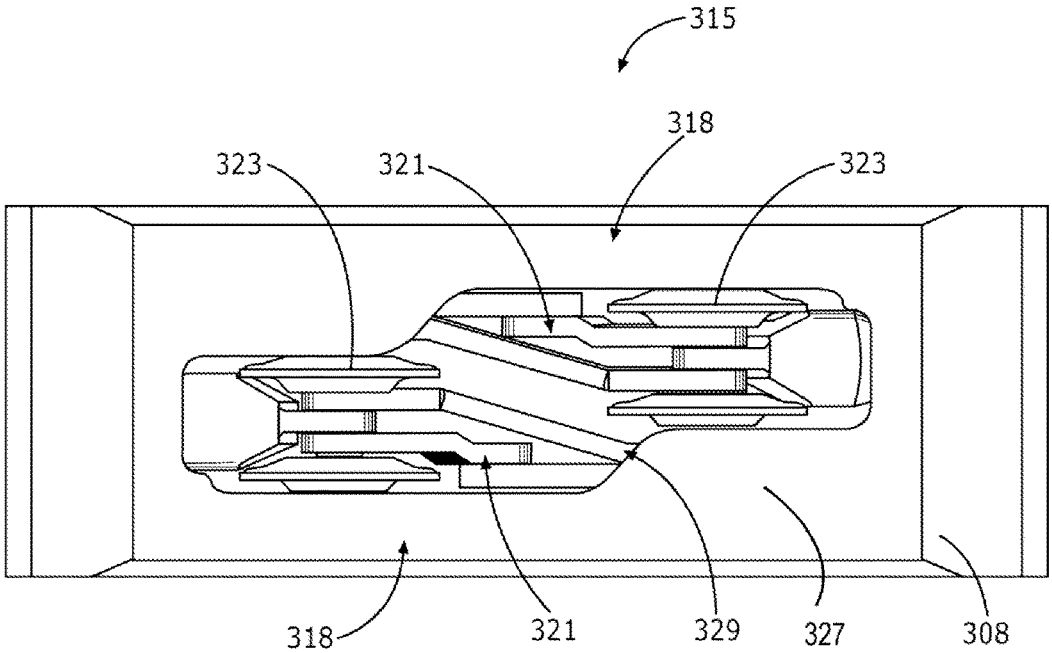
FIG. 7 depicts a plan view of a drill string attachment or insert which includes a pair of rotational anchor mechanisms in accordance with an example embodiment.

As can be seen in FIGS. 6 and 7 (which show a pair of the rotational anchor mechanisms 318 of one of the devices 315 viewed radially inwards and orthogonally to the roller axes 436), one or more of the link bars may be laterally angled or bent (i.e., diverting circumferentially or tangentially from the lengthwise direction of the link). In this example, the proximal end (at point 0) of the rigid mounting link 400 is axially partially in register with the proximal end (at point B) of the indirect mounting link 420, but has a lateral step 606 adjacent the indirect mounting link 420, to clear link 420 at point B. As a result, the rigid mounting link 400 and the indirect mounting link 420 is in closely spaced side-by-side arrangement adjacent the mounting axis 404. A mounting formation at point B may thus provide lateral anchorage for the rigid mounting link 400.

At and adjacent to the mounting axis 428 of the indirect mounting link 420, the rigid mounting link 400 is in axial alignment with the proximal end of the intermediate link 424 (at point E). The rigid mounting link 400 again angles laterally outward, however, at a central kink 612, to clear the intermediate link 424. Finally, the rigid mounting link 400 has a reverse kink 618 adjacent its distal end (at point A), so that a portion of the rigid mounting link 400 at its distal end extends axially, when seen in the orientation of FIGS. 6 and 7.

The intermediate link 424 has a single lateral step to position a terminal portion of the intermediate link 424 such that the distal end 533 of the telescopic bar 331 is laterally sandwiched at the outer joint 408 (at point A) between the distal ends of the rigid mounting link 400 and the intermediate link 424. The distal ends of the respective links connected together at the outer joint 408 have respective laterally extending openings or eyes (i.e., extending tangentially relative to the borehole 104) which are co-axially aligned to receive the spindle 537 of the roller 323. As mentioned before, the distal ends of the relevant links at the outer joint 408 are sandwiched between the blades 325 of the roller 323.

The lateral configuration of the anchor linkage 321 in general, and of the rigid mounting link 400 (0A), in particular, permits special arrangement of a pair of the rotational anchor mechanisms 318 such that they have a compact lateral profile. The anchor linkages 321 of the respective rotational anchor mechanisms 318 in an associated pair have opposite axial orientations (e.g., being rotated through 180° when viewed in the direction of FIG. 6). This permits positioning of the roller 323 of one of the rotational anchor mechanisms 318 in a lateral space or pocket defined by the other mechanism 318.

Figure 9:
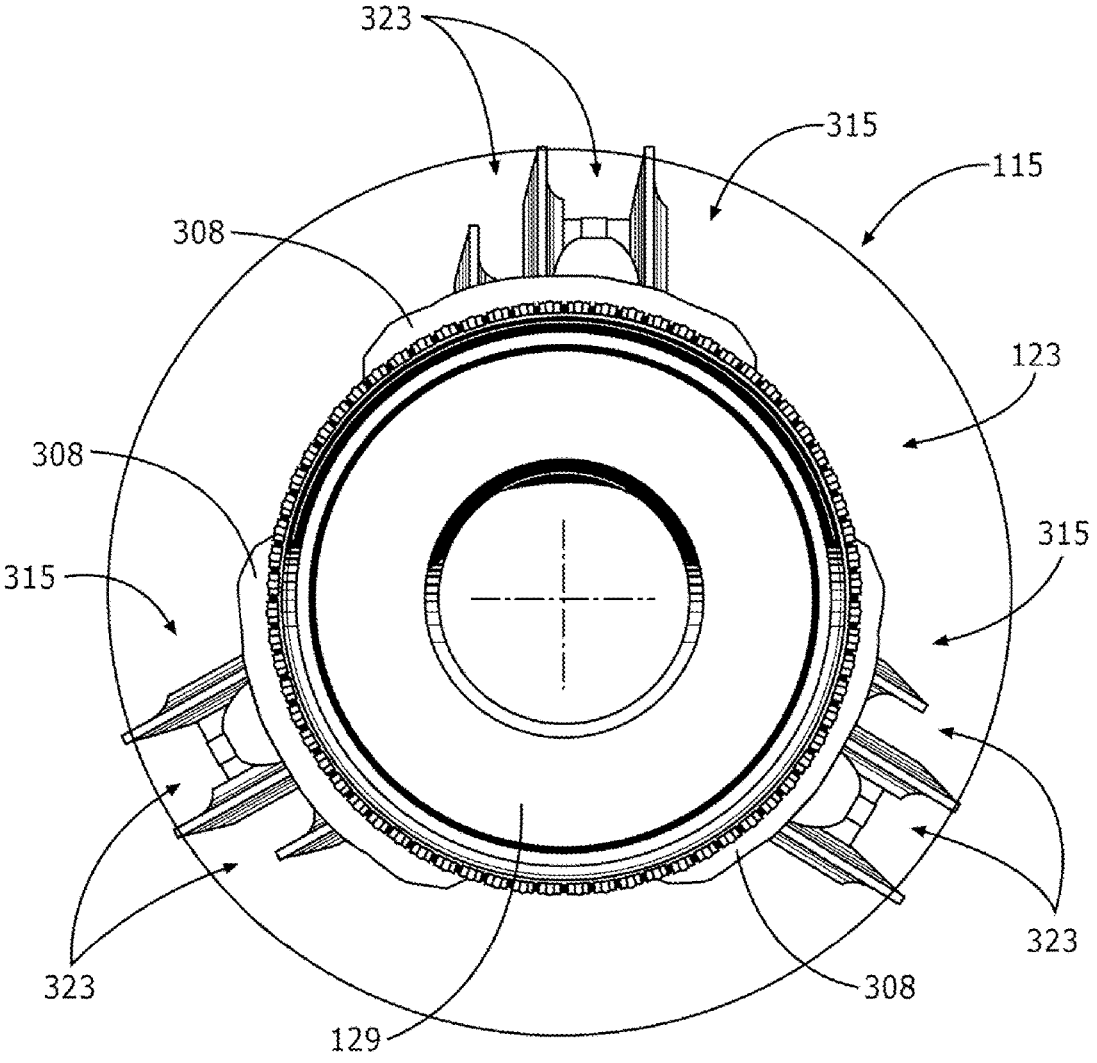
FIG. 9 comprises an axial end view of a drill string apparatus comprising a non-rotating housing and a plurality of rotational anchor devices or anti-rotation devices in accordance with an example embodiment, each rotational anchor device comprising a pair of rotational anchor mechanisms that are, for the purposes of illustration, shown as being in an expanded condition and in a retracted condition respectively.

As can be seen in FIG. 6, and also in FIG. 9, the configuration of the mechanisms 318 as described permits relative circumferential positioning of the rollers 323 such that they at least partially overlap, when viewed in an axial direction (FIG. 9). A cumulative lateral width of the pair of rotational anchor mechanisms 318 is thus less than twice the lateral width of one of the mechanisms 318. Note that one of the anchor linkages 321 of each rotational anchor device 315 is shown in FIG. 9 as being radially expanded, the other anchor linkage 321 being shown in a radially retracted condition. The staggered expansion of FIG. 9 is shown to illustrate the circumferential overlap between the rollers 323 in a pair, and to accentuate the independent expandability of the respective anchor linkages in each pair. A further advantage of the lateral profile of the links, as described, is that lateral stiffness of the anchor linkage 321 is enhanced by a greater lateral width, promoting effective torque transfer between the formation and the housing 129 via the anchor linkage 321.

Figure 8:
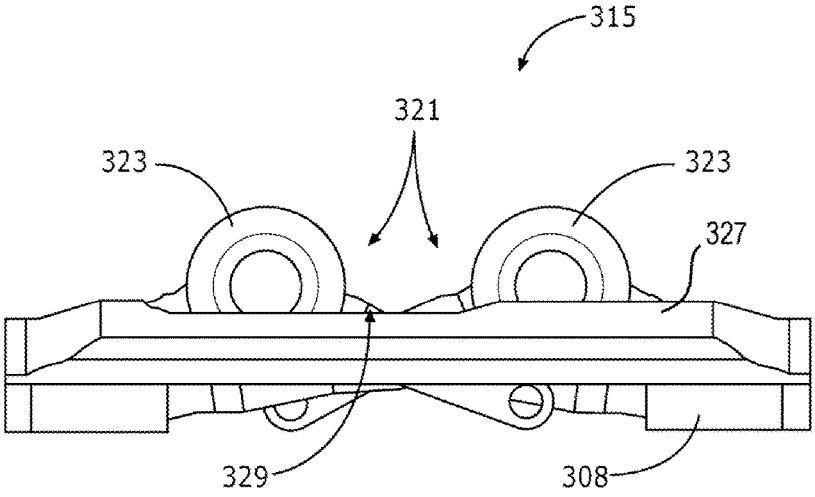
FIG. 8 depicts a partial side view of a drill string attachment which includes a pair of rotational anchor mechanisms in accordance with an example embodiment.

As can best be seen in FIG. 7, the slot 329 of the cover 327 can have a flattened S-shaped outline, accommodating the naturally staggered positions of the rollers 323 and those parts of the respective articulated anchor linkages 321 that project radially beyond the cover 327 when the anchor linkages 321 are in their fully expanded conditions (see, e.g., FIG. 8).

In operation, the articulated anchor linkages 321 are initially fully expanded (e.g., FIG. 8), being urged radially outwards by the spring action of the telescopic bar 331. Once in the borehole 104, however, the rollers 323 bear against the borehole wall 115 and are pushed radially inward, towards the housing 129. The anchor linkage 321 is resiliently resistant to such radial compression (again, because of the resilient compression of the spring 529 of the telescopic bar 331 responsive to radial contraction of the anchor linkage 321), so that a radially outward force generally normal to the relevant portion of the borehole wall 115 is exerted by the anchor linkage 321 on the roller 323.

Bearing friction between the driveshaft passing through the housing 129 exerts a rotational torque on the housing 129, tending to rotate the housing 129 with the driveshaft. Contact forces between the rollers 323 and the borehole wall 115 have both a radial component and a tangential component, when the drill pipe 118 is rotated, exerting an anti-rotational moment on the housing 129 via the anchor linkage 321. The contact between the rollers 323 and the borehole wall 115 may occasionally comprise surface contact only, in which case rotational resistance is mainly because of friction between the rollers 323 and the borehole wall 115. The rollers 323, however, typically cut into the borehole wall, penetrating the Earth formation, so that the rotational or tangential interaction may be, at least some extent, because of positive engagement between the rollers 323 and the borehole wall 115. To promote such positive engagement, the rollers 323 may be shaped such that each roller tapers to a relatively sharp circumferentially extending radially outer periphery or rim, ploughshare-fashion.

The radial spacing of the outer diameter of the housing 129 from the borehole wall 115 may vary during drilling operations. Thus, for example, a side of the housing 129 that is on the inside of a bend or curved during deviation of the drilling direction is typically closer to the wall 115 than is the case on the diametrically opposite side of the housing 129. Rotational eccentricities in the drill string 108 may also cause cyclical or oscillating radial movement of the housing 129.

The sprung linkage 321 is constructed to dynamically accommodate such variability in radial position, while maintaining a sufficiently radially outward acting anchoring force to promote rotational anchoring of the rollers 323 to the borehole wall 115. Responsive to a reduction in a radial spacing at the relevant longitudinal position, the associated roller 323 serves as a prime mover for the linkage 321, acting directly on the variable mounting link 331, the rigid mounting link 400, and the intermediate link 424 via the spindle 537 at the outer joint 408. Because the rigid mounting link 400 is rigid and has a fixed hinge or pivot mount on the housing 129, the outer joint axis 436 is limited to arcuate movement about the mounting axis 404. The locus of the joint axis 436 is schematically indicated in FIG. 4A by arc 440, which lies on radius OA.

To accommodate movement of the controller 323 towards the housing 129, the variable mounting link 331 dynamically shortens telescopically, compressing the spring 529. An actuating force exerted by the spring on the variable mounting link 331 along its lengthwise direction therefore increases progressively as the roller 323 approaches the housing 129. Note, however, that the angular orientation of the variable mounting link 331 also varies corresponding to radial expansion of the linkage 321. In particular, the angle (indicated by reference symbol β in FIG. 4) at which the variable mounting link 331 extends to the lengthwise direction of the drill string 108 decreases as the roller 323 is pushed closer to the housing 129, so that a smaller proportional component of the extension force acts radially outwards. Different from typical suspension systems, such as vehicle suspensions, it is not necessarily desirable for the linkage 321 of the rotational anchor mechanism 318 to provide progressively greater resistance to displacement of the suspended member (e.g., the roller 323) towards a body on which is mounted. Whereas it is desirable for a suspension force acting between a vehicle wheel and a vehicle chassis to be at its greatest closest to the body and progressively to decrease as it moves away from the chassis, the radial expansion force exerted by the linkage 321 on the roller 323 at the outer extremes of its range of motion (FIG. 4B) is of notable significance with respect to its rotational anchoring function.

As explained above, the magnitude of the radial force acting normally to the borehole wall 115 is determinative to the torque-transfer characteristics of the roller 323's engagement with the borehole wall 115. A tangential friction force, for example, can be expected to be proportional to the radial expansion force in instances where formation penetration is negligible. From a comparison of the FIG. 4A and FIG. 4B, it will be seen that the variable mounting link 331 (and therefore the expansion force acting on it) approaches the longitudinal axis in the fully retracted condition (FIG. 4B), and is notably more upright in its fully extended condition (FIG. 4A). In this example, the included angle between the force-exertion axis (DA) of the variable mounting link 331 and the lengthwise direction of the housing is variable between about 10° (FIG. 4A) and at about 30° (FIG. 4B). In some embodiments, the lengths and arrangement of the linkage components may be selected such that the radial expansion force is substantially constant for movement of the roller 323 along the arc 440, while the linkage may, in other embodiments, being configured to exert a greater radial force on the roller 323 in its fully expanded condition (FIG. 4B) than it does in its fully retracted condition (FIG. 4A). Note that the primary function of the rotational anchor devices 315 is to resist rotation of the housing 129 relative to the formation, not to center the housing 129 transversely in the borehole 104 (although the housing 129 will to some extent be kept clear of the borehole wall 115 by the rotational anchor devices 315). A lever arm of tangential forces acting on the roller 323 increases with an increase in radial spacing of the roller. A rotation-resisting moment opposite to the rotation of the drill pipe 118 may thus be larger where the housing 129 (if eccentric) is furthest from the wall 115, provided that the roller 323 is urged outwards by the anchor linkage 321 with sufficient force.

During radial inward movement of the roller 323 along arc 440, the indirect mounting link 420 pivots about mounting axis 428 in a direction opposite to that of the rigid mounting link 400, decreasing an included angle that it forms with the housing 129's longitudinal direction. The intermediate link 424 pivots radially outward relative to the indirect mounting link 420 about their common joint axis at point E, while simultaneously pivoting towards the housing 129 about the joint axis 436 of the roller 323. Articulation of the composite support member extending between the roller 323 and the mounting axis 428 (i.e., composite link AE-EB) allows dynamic shortening thereof to accommodate arcuate movement of the joint axis 436.

As shown in FIG. 4B, the intermediate link 424 and the indirect mounting link 420 are dimensioned and arranged so that they are more or less in rectilinear end-to-end alignment when the support linkage 321 is fully extended, so their relative pivoting facilitates longitudinal force transfer between the housing 129 and the roller 323 along line AB. In this extended condition, the intermediate link 424 extends at an angle relative to the radial that mirrors the angle of the telescopic bar 331, promoting approximately similar proportional relationships between radial and longitudinal components of the respective links.

Referring briefly to FIG. 6, it can be seen that the intermediate link 424 and the rigid mounting link 400 are laterally spaced apart at least by the width of the telescopic bar 331's end formation 533 sandwiched between them. A significant difference in forces acting respectively along these links can therefore tend to twist the roller axis 412 out of the perpendicular relative to the drill string axis 209, with undesirable results. Referring again to FIGS. 4A and 4B, it will be noted that the intermediate link 424 and the indirect mounting link 420 are configured such that the intermediate link 424 has an orientation similar to the orientation of a terminal portion of the rigid mounting link 400 (0A) throughout the range of motion of the anchor linkage 321.

The above-described articulation of the anchor linkage 321 is with respect to its response to the roller axis 412 being pushed radially inwards. When the housing 129 moves radially further away from the borehole wall, or when the formation is further penetrated by a roller 323, articulation of the respective components of the anchor linkage 321 occurs in the reverse to what is described above, pushing the roller axis 412 radially outwards into contact with the borehole wall 115. The prime mover in expansion of the anchor linkage 321 is the telescopic bar 331, and in particular, the radially outer tube 519 which is slidingly pushed away from the mounting axis 416 under actuation by the spring 529.

A feature of the anchor linkage 321 of the example embodiment is that although the variable link provided by the telescopic bar 331 is at a relatively low angle relative to the radial (particularly in the fully retracted condition shown in FIG. 4A), a radial component of the actuating force provided by the spring 529 and acting along line DA is reinforced or amplified by resistive forces transferred from the housing 129 to the roller 323 via the opposed mounting links along line BE-EA and line OA respectively.

The example steering tool 123 displays a number of benefits over existing drill string assemblies or tools that have non-rotating components (such as the housing 129) which are to be kept rotationally static during rotation of the drill pipe 118. Some of these benefits are evident when the example rotational anchor mechanism 318 is compared to the well-known Peaucellier linkage, which translates rotational motion to rectilinear motion, or vice versa, and which has been employed in some existing rotational anchor mechanisms.

The Peaucellier linkage typically comprises a 6-bar planar linkage, the bars being of fixed length and being pivotally interconnected about parallel joint axes. In the Peaucellier linkage, four of the bars are arranged in a rhomboid configuration, being equal in length and being pivotally connected in a quadrangle. For ease of explanation, and mirroring the labels used above with reference to FIG. 4, the corners of the rhombus thus forms may be named A, B, C, and D. A pair of longer bars are pivotally connected to respective joints at opposite vertices of the rhombus ABCD. The longer bars are pivotally connected together at their opposite ends, typically being pivotable about a fixed point (say, O). Points O, B, and D are aligned and lie on a symmetrical axis of the Peaucellier linkage.

If movement of point B of the Peaucellier linkage is constrained to describe a circle, then point D necessary describes a straight line perpendicular to the axis of symmetry. Conversely, if point D is constrained is to move along a straight line (which does not pass through point O), then the locus of points B necessarily describes a circle passing through O. The Peaucellier linkage therefore translates circular motion to rectilinear motion, or vice versa.

The example anchor linkage 321 is analogous to the Peaucellier linkage, but is different in a number of significant aspects. First, the actuated anchor member (e.g., the roller 323) is moved along an arcuate or curved path, as opposed to tracing a straight line. Note that, like the anchor linkage 321, points A and D of Peaucellier are connected by a rigid link. Only one of joints O, B, and D of the Peaucellier linkage, however, can be fixedly mounted at any time. Because, however, both joint 0 and D of the linkage 321 are fixedly mounted on a common support structure, the roller joint axis 436 (A) is constrained to move along the arc 440, while the variable mounting link 331 (OA) dynamically varies in length to accommodate arcuate movement of the roller axis about D. The mechanism 318 is also more compact than the Peaucellier mechanism, because a symmetrical half of the Peaucellier linkage is made redundant, so that links OC, BC, and DC are omitted.

Whereas Peaucellier's linkage has only one fixed pivot axis (e.g., O) the anchor linkage 321 is fixed to the housing by mounting links pivoting about axes 416, 428, and 404 respectively. The anchor linkage 321 therefore has three fixed mounting axes. The provision of additional mounting axes (e.g., 404 and 428) provides several benefits. Longitudinal stiffness of the anchor linkage 321 is greatly enhanced, relative to that of the Peaucellier's linkage, as there is no axial sliding of mounting axes B and O. Instead, the mounting axes B, D, and O maintain an unchanged spatial relationship during extension or retraction of the linkage 321. An axial component of the telescopic bar's extension force acting along line DA is resisted not only by the rigid element of link AO, but is also resisted by composite link AEB.

As mentioned above, the actuating force acting along line DA is approximately equal and opposite to axial components of resistive forces acting along composite link BEA and the rigid mounting link 400 (OA) responsive to their being pushed axially against their fixed mountings to the housing 129. While the axial components of the links on opposite longitudinal sides of the joint axis therefore effectively cancel each other out, these forces act in the same radial direction, i.e., radially outwards. Due to the axial rigidity of the linkage 321, the radially outward force acting on the joint axis 436 is amplified by transfer of resistive forces from the housing 129 to the joint axis 436. The Peaucellier's linkage, for example, cannot harness such a mechanism, because its joint axes corresponding to axes B and O are displaced relative to a single, fixed mounting axis. The mechanism 318 is also robust and reliable, particularly when compared to the Peaucellier's linkage's two slidable mounting points.

The composite link BA can further be viewed as a modification of the Peaucellier link mechanism that comprises providing a pivotal joint in the Peaucellier bar that forms an internal side of the rhombus (e.g., link BA). The intermediate link 424 and the indirect mounting link 420 can thus be interpreted as an articulated linkage component providing a connection between the joint axis 436 (A) and the inner mounting axis 428 (B), being variable in length to dynamically change the distance between point B and A. The articulation of connection BA not only permits dynamic length variation that is required if the joint axis 436 is to trace a constant radius about mounting axis 416 (O), while the composite link AB is fixedly mounted at axis B, but also provides for dynamic change in configuration of the composite link AB during radial expansion/contraction. In this manner, the indirect mounting link 420 (BE) achieves a low profile when the mechanism 318 is fully retracted (FIG. 4A), extending substantially axially, but having an angular orientation similar to that of the intermediate link 424 (AE) when the mechanism is extended.

Note that the composite link AB in this example serves as a support member, adding rigidity and structural support to the roller 323, rather than performing a guiding function characteristic of links in classical planar linkages. Consider, for example, that removal of the composite link AB would not affect the path traced by the joint axis 436. Instead, the arcuate path 440 of the roller 323 is fully described by the structural characteristics and arrangement of the variable length link DA and the rigid mounting link AO. By the force mechanics described earlier, the articulated composite link AB provides structural support for the roller 323 by: (a) (together with the rigid mounting link AO) resisting axial movement of the roller 323 under the urging of the telescopic bar 331; (b) contributing to the radial outward urging of the roller 323, as described; and (c) providing lateral support to the roller 323 (see, e.g., FIG. 6) so that a distribution of forces act acting axially on the roller 323 is laterally balanced about the axial centerline of the roller 323.

Yet a further difference between the Peaucellier linkage and the anchor linkage 321 is the provision of an actuating mechanism or an expansion bias mechanism that is incorporated in the linkage 321, in this example being provided by the spring 529 housed in the telescopic bar 331. The spring 529 is, in this example, the sole source of energy which drives radial expansion of the anchor linkage 321. The sprung telescopic bar 331 has the benefit of being compact and reliable (sealing the spring 529, for example, from exposure to drilling fluid in the annulus). The sprung variable link also provides for the actuating force provided by the spring to change angular orientation responsive to linkage expansion/contraction, which may be employed beneficially as described earlier. Dynamic variability in angular orientation of the spring mechanism housed in the variable link DA allows the linkage 321 to have a low radial profile in the fully retracted condition (FIG. 4A). As mentioned, the telescopic bar 331 extends at a relatively small angle relative to the longitudinal, when retracted, so that the rotational anchor mechanism 318 has a reduced radial width in comparison to existing mechanisms in which one or more actuation springs have a fixed radially extending orientation. Note that space across the diameter of the borehole 104 is at a premium, so that a reduction in the radial profile of the rotational anchor mechanism 318 may permit, for example, a larger bore diameter in the drill pipe 118.

A benefit of an assembly (e.g., example rotational anchor device 315) having two or more of the rotational anchor mechanisms 318 is that the rollers 323 are connected to the housing 129 by an independent anchor linkage. The radial position of each roller 323 is thus independent of the radial positions of the other rollers 323 of the device 315. This feature is illustrated in FIG. 9, in which one of the rollers 323 of each rotational anchor device 315 is shown as being fully extended, while the other roller 323 of each pair is shown in its fully retracted condition. Such independently adjustable sprung suspension promotes efficient independent adjustment of penetration into the formation based on localized formation properties. Rollers of prior rotational anchor mechanisms 318 are often deployable together or in synchronicity, which can have the effect of limiting formation penetration. U.S. Pat. No. 7,188,689, for example, describes a suspension mechanism in which a pair of rollers are mounted one behind the other on a common radially displaceable carriage, with the effect that the degree of penetration of the rollers into the formation is limited to the penetration of the roller on the comment carriage which leased successfully penetrates the formation.

The rotational anchor device 315 is of modular design, the frame 308 and mounting mechanism of the rotational anchor device 315 in some embodiments being of standard size and configuration. Maintenance and repair of the steering tool 123 is simplified by the provision of the modular rotational anchor devices 315, allowing, for example, tool assembly or repair on a rig site. Modularity of the system enables the provision of a range of rotational anchor devices 315 with different performance parameters, to be interchangeably mountable on the housing 129. This allows an operator to select differently configured devices 315 for different applications, or to remove and replace the modular rotational anchor devices 315 on site. Such a movement and replacement of the rotational anchor devices 315 is facilitated by the operatively non-rotating character of the housing 129.

The rotational anchor mechanism 318 lends itself to modification or customization to achieve desired performance parameters. This feature facilitates the provision of a range of modular rotational anchor devices 315, with different performance parameters of the different models in the range being achieved by modification of the rotational anchor mechanism. The spring 529 may, for example, be adjusted or selected to provide a desired expansion force. In some embodiments, a series of nested springs may be provided. Instead, or in addition, the lengths of the mechanism 318's link members (e.g., links AE, EB, and AO) may be varied, to change the travel path of the roller 323.

In addition, mechanism 318 is of relatively simple construction and low cost. The pivotable connection of the link members, for example, is of low complexity and high reliability. In one embodiment, the link members of the mechanism 318 can comprise square steel bars.

One aspect of the described embodiments therefore discloses a rotational anchoring mechanism for a substantially non-rotating housing of a drill tool assembly, to anchor the non-rotating housing against rotation when the housing is mounted substantially co-axially on a rotatably driven drill pipe extending longitudinally along a borehole, the non-rotating housing being radially spaced from a borehole wall, the anchoring mechanism comprising:

an anchor member configured for rotation-resistant engagement with the borehole wall responsive to radially forced contact with the borehole wall;

an anchor linkage coupling the anchor member displaceably to the housing such that variation in radial expansion of the anchor linkage is synchronously linked to variation a radial spacing between the housing and the anchor member, the anchor linkage comprising a plurality of operatively coupled mounting links mounted on the housing to pivot about respective mounting axes which are substantially parallel to one another in a fixed spatial relationship; and an actuating mechanism coupled to the anchor linkage to urge radial expansion of the anchor linkage by exerting an actuating force on the anchor linkage, an angular orientation of the actuating force relative to the housing being variable responsive to variation in radial expansion of the anchor linkage.

The linkage may comprise one or more rigid link of constant length, and a variable link that is dynamically variable both in length and in angular orientation responsive to variation in radial expansion of the of the anchor linkage. One of the mounting links may be provided by the variable link. In some examples, the mounting link may comprise a variable link and a rigid link.

Descriptions of and references to the "length" of a link in this disclosure means a shortest distance between respective connections of the link to another link in the linkage, and/or to a pivotal mounting on the housing.

The anchor linkage may comprise a resiliently elastic spring arrangement, such as a helical compression spring, forming part of the anchor linkage. The actuating mechanism may thus be incorporated in the anchor linkage so that there are no elements extraneous to the anchor linkage that act between the anchor linkage and the housing to urge radial expansion of the anchor linkage.

The spring arrangement may be operatively connected to the variable link, to urge lengthwise extension of the variable link, the anchor linkage being configured such that extension of the variable link causes actuated radial expansion of the anchor linkage, together with synchronous pivotal displacement of the variable link.

The variable link may comprise link components that are co-axially aligned and are longitudinally slidable relative to each other, the spring arrangement being connected to the link components to urge sliding lengthwise displacement of the components away from each other, so that the actuating force is aligned with the lengthwise direction of the variable link. Pivoting of the variable link, e.g. about an associated mounting axis, during actuated radial expansion/contraction of the anchor linkage thus causes the actuating force to change its inclination relative to the borehole axis.

The anchor linkage may be configured such that, when the anchor linkage is in a fully retracted condition, the variable link extends at a relatively shallow angle relative to the longitudinal axis of the housing, giving the anchor linkage a relatively low radial profile. In some embodiments, an included angle between the spring-loaded variable link, in the retracted condition, is less than 30°, one in some embodiments may provide an included angle less than 20°.

In some embodiments, the variable link may be a telescopic bar, having, for example, a generally tubular link components that are telescopically connected together, the spring arrangement being housed in a hollow interior, to urge the link components apart.

One of the plurality of mounting links may be provided by the variable link, which may be pivotally mounted at a proximal end thereof on the housing for pivoting about an associated one of the mounting axes. In such case, the variable link may be pivotally connected at a distal end thereof to a particular one of the one or more rigid links.

The variable link may be pivotally connected at its distal end to a rigid mounting link, so that a triangle is defined between a pivotal joint axis and the respective mounting axes of the variable link and the rigid link. Two of the legs of such a triangle (e.g., a line between the mounting axes, and the length of the rigid mounting link) will in such an instant remain constant in length during variation in radial expansion of the anchor linkage, with the remaining leg of the triangle (e.g., corresponding to the length of the variable link) being variable in length to accommodate articulation of the linkage. The joint axis in such a construction will describe an arc about the mounting axis of the rigid mounting link. The anchor member may be mounted at or adjacent this arcuately displaceable joint axis, so that the anchor member, an operation, describes a travel path that is curved, forming an arc with a radius equal to the length of the rigid mounting link and having its center at the associated mounting axis.

The anchor linkage may further comprise a third mounting link (e.g., in addition to the variable mounting link and the rigid mounting link), which may be indirectly connected to the anchor member. In one example, the third mounting link is provided by a rigid link pivoting about an associated one of the mounting axes, the third mounting link being connected to the variable link's pivot joint by an intermediate link which is pivotally connected at its opposite ends to the variable link and the intermediate link respectively.

The two or more mounting links of the anchor linkage may together provide an exclusive connection to the housing, so that the anchor linkage is mounted on the housing by the mounting links only, and that there is no other mounting interface or connection interface between the anchor linkage and the housing. A "fixed" mounting or connection in this disclosure, unless the context clearly indicates otherwise, means a mounting or connection by which the associated member is restrained from translation relative to the frame of reference (typically the housing), even though pivotal or rotational movement at the connection or mounting may be permitted. Differently defined, the anchor linkage may have a plurality of fixed mountings, each comprising a connection with a single, pivotal degree of freedom.

The anchor linkage may form part of a removable and replaceable attachment or insert, the anchor linkage, for example, being mounted on a frame which is removably and replaceably mounted on the non-rotating housing, to form a semipermanent part of a well tool assembly which the non-rotating housing forms part.

Other aspects of the disclosure described by the example embodiments include, inter alia, a downhole tool assembly that includes one or more of the rotational anchoring mechanisms, a drill string having one or more of the rotational anchoring mechanisms, a drilling installation comprising a drill string with one or more of the rotational anchoring mechanisms, and a method for anchoring a drill string component against rotation using a rotational anchoring mechanism as described.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A downhole tool assembly configured for use in a drill string within a borehole, wherein the drill string will comprise rotatably driven drill pipe which is radially spaced from a borehole wall, the assembly comprising:

a substantially non-rotating housing configured for substantially co-axial, relatively rotatable mounting on the drill pipe;

an anchor member configured for rotation-resistant engagement with the borehole wall responsive to radially forced contact with the borehole wall, wherein the anchor member comprises a plurality of operatively coupled mounting links mounted on the housing to pivot about respective mounting axes which are substantially parallel to one another in a fixed spatial relationship;

an anchor linkage coupling the anchor member displaceably to the housing such that variation in radial expansion of the anchor linkage is synchronously linked to variation in a radial spacing between the housing and the anchor member, the anchor linkage comprising, a constant length link comprising one or more rigid links; and a variable length link coupled via a spindle axis to the constant length link, wherein the variable length link comprises a pair of slidably connected rigid link members; and an actuating mechanism coupled to the anchor linkage to urge radial expansion of the anchor linkage by exerting an actuating force on the anchor linkage, an angular orientation of the actuating force relative to the housing being variable responsive to variation in radial expansion of the anchor linkage.

2. The assembly of claim 1, wherein the variable length link is dynamically variable both in length and in angular orientation responsive to variation in radial expansion of the anchor linkage, wherein the variable length link expands in response to the radial expansion of the anchor linkage to radially force contact of the anchor member with the borehole wall.

3. The assembly of claim 2, wherein the actuating mechanism comprises a resiliently elastic spring arrangement forming part of the anchor linkage.

4. The assembly of claim 3, wherein the spring arrangement is operatively connected to the variable length link, to urge lengthwise extension of the variable length link, the anchor linkage being configured such that extension of the variable length link causes actuated radial expansion of the anchor linkage.

5. The assembly of claim 4, wherein the variable length link comprises link components that are co-axially aligned and are longitudinally slidable relative to each other, the spring arrangement being connected to the link components to urge sliding lengthwise displacement of the components away from each other, so that the actuating force is aligned with the lengthwise direction of the variable length link.

6. The assembly of claim 5, wherein the anchor linkage is configured such that, when the anchor linkage is in a fully retracted condition, the variable length link extends at an angle of less than 30° relative to a longitudinal axis of the housing.

7. The assembly of claim 5, wherein the link components of the variable length link are telescopically connected together, the spring arrangement being housed in a hollow interior of at least one of the link components, to urge the link components apart.

8. The assembly of claim 2, wherein the variable length link provides one of the plurality of mounting links, being pivotally mounted at a proximal end thereof on the housing for pivoting about an associated one of the mounting axes, the variable length link being pivotally connected at a distal end thereof to a particular one of the one or more rigid links.

9. The assembly of claim 8, wherein the particular rigid link is one of the mounting links, so that a pivotal joint is formed between the variable length link and the particular rigid link.

10. The assembly of claim 9, wherein the anchor member is mounted at or adjacent the pivotal joint.

11. The assembly of claim 8, wherein the anchor linkage comprises a third mounting link provided by one of the rigid links mounted at a proximal end thereof for pivotal displacement about an associated one of the mounting axes, and being pivotally connected at a distal end thereof to an intermediate link that connects the third mounting link to the variable length link.

12. The assembly of claim 1, wherein the anchor linkage is configured to guide movement of the anchor member responsive to variation in radial expansion of the anchor linkage along a curved travel path.

13. The assembly of claim 1, further comprising a frame to which the anchor linkage is connected, the frame being removably and replaceably mounted on the housing to provide connection of one or more of the mounting links on the housing, via the frame.

14. A rotational anchor apparatus configured for use with a non-rotating housing of a downhole tool, wherein the non-rotating housing will be rotatably mounted on a drill pipe within a borehole, the rotational anchor apparatus comprising:

an anchor member configured for rotation-resistant engagement with a borehole wall responsive to radially forced contact with the borehole wall, wherein the anchor member comprises a plurality of operatively coupled mounting links mounted on the housing to pivot about respective mounting axes which are substantially parallel to one another in a fixed spatial relationship;

an anchor linkage that couples the anchor member displaceably to the housing such that variation in radial expansion of the anchor linkage is synchronously linked to variation in a radial spacing between the housing and the anchor member, the anchor linkage comprising, a constant length link comprising one or more rigid links; and a variable length link coupled via a spindle axis to the constant length link, wherein the variable length link comprises a pair of slidably connected rigid link members; and an actuating mechanism coupled to the anchor linkage to urge radial expansion of the anchor linkage by exerting an actuating force on the anchor linkage, an angular orientation of the actuating force relative to the mounting axes being variable responsive to variation in radial expansion of the anchor linkage.

15. The rotational anchor apparatus of claim 14, further comprising a frame to which the plurality of mounting links of the anchor member are pivotally mounted, the frame being configured for removable and replaceable mounting on the non-rotating housing.

16. The rotational anchor apparatus of claim 14, wherein the variable length link is dynamically variable both in length and in angular orientation responsive to variation in radial expansion of the of the anchor linkage.

17. The rotational anchor apparatus of claim 16, wherein the actuating mechanism comprises a spring arrangement operatively connected to the variable length link to exert the actuating force along a lengthwise direction of the variable length link, the anchor linkage being configured such that extension of the variable length link causes actuated radial expansion of the anchor linkage, and changes the angular orientation of the variable length link.

18. The rotational anchor apparatus of claim 16, wherein the variable length link provides one of the plurality of mounting links, being pivotally mounted at a proximal end thereof for pivoting about an associated one of the mounting axes, the variable length link being pivotally connected at a distal end thereof to a particular one of the one or more rigid links.

19. The rotational anchor apparatus of claim 18, wherein the particular rigid link is one of the mounting links, so that a pivotal joint is formed between the variable length link and the particular rigid link.

20. The rotational anchor apparatus of claim 19, wherein the anchor member is mounted at or adjacent the pivotal joint.

21. A drilling installation comprising:

a drill string extending longitudinally along a borehole, the drill string having a drilling tubular drill pipe that is rotatably drivable and is radially spaced from a borehole wall, wherein the drill string includes a downhole tool having a non-rotating housing that is mounted co-axially on the drill pipe, the non-rotating housing configured to maintain a constant rotational orientation during driven rotation of the drill pipe;

an anchor member configured for rotation-resistant engagement with a borehole wall responsive to the anchor member being forced radially against the borehole wall, wherein the anchor member comprises a plurality of operatively coupled mounting links mounted on the housing to pivot about respective mounting axes which are substantially parallel to one another in a fixed spatial relationship;

an anchor linkage coupling the anchor member displaceably to the housing such that variation in radial expansion of the anchor linkage is synchronously linked to variation in a radial spacing between the housing and the anchor member, the anchor linkage comprising, a constant length link comprising one or more rigid links; and a variable length link coupled via a spindle axis to the constant length link, wherein the variable length link comprises a pair of slidably connected rigid link members; and an actuating mechanism coupled to the anchor linkage to urge radial expansion of the anchor linkage by exerting an actuating force on the anchor linkage, an angular orientation of the actuating force relative to the mounting axes being variable responsive to variation in radial expansion of the anchor linkage.

22. The drilling installation of claim 21, further comprising a frame to which the plurality of mounting links of the anchor member are pivotally mounted, the frame being removably and replaceably connected on the non-rotating housing.

23. The drilling installation of claim 22, further comprising a plurality of the frames mounted on the housing at regular circumferential intervals.

24. The drilling installation of claim 23, wherein each of the frames carries at least two independently expandable anchor linkages with associated anchor members.

25. The drilling installation of claim 21, wherein the variable length link is dynamically variable both in length and in angular orientation responsive to variation in radial expansion of the of the anchor linkage.

26. The drilling installation of claim 25, wherein the actuating mechanism comprises a spring arrangement operatively connected to the variable length link to exert the actuating force along a lengthwise direction of the variable length link, the anchor linkage being configured such that extension of the variable length link causes actuated radial expansion of the anchor linkage, and changes the angular orientation of the variable length link.

27. The drilling installation of claim 25, wherein the variable length link provides one of the plurality of mounting links, being pivotally mounted at a proximal end thereof for pivoting about an associated one of the mounting axes, the variable length link being pivotally connected at a distal end thereof to a particular one of the one or more rigid links.

28. The drilling installation of claim 27, wherein the particular rigid link is one of the mounting links, so that a pivotal joint is formed between the variable length link and the particular rigid link.

29. The drilling installation of claim 28, wherein the anchor member is mounted at or adjacent the pivotal joint.

30. The drilling installation of claim 29, wherein the anchor linkage comprises a third mounting link provided by one of the rigid links mounted at a proximal end thereof for pivotal displacement about an associated one of the mounting axes, and being pivotally connected at a distal end thereof to an intermediate link that connects the third mounting link to the variable length link.

31. The drilling installation of claim 21, wherein the anchor linkage is configured to guide movement of the anchor member responsive to variation in radial expansion of the anchor linkage along a curved travel path.

* * * * *